US006817055B1

(12) United States Patent
Ekholm

(10) Patent No.: US 6,817,055 B1
(45) Date of Patent: Nov. 16, 2004

(54) METHOD FOR MOUNTING A DRUM AS WELL AS A DRUM AND AN AXLE FOR A BRUSH ROLLER

(75) Inventor: Hans Ekholm, Vasteras (SE)

(73) Assignee: SIB Svenska Industri Borstar i Västerås AB (SE)

( * ) Notice: Subject to any disclaimer, the term of this patent is extended or adjusted under 35 U.S.C. 154(b) by 0 days.

(21) Appl. No.: 09/914,479

(22) PCT Filed: Mar. 2, 2000

(86) PCT No.: PCT/SE00/00416

§ 371 (c)(1),
(2), (4) Date: Aug. 28, 2001

(87) PCT Pub. No.: WO00/51461

PCT Pub. Date: Sep. 8, 2000

(30) Foreign Application Priority Data

Mar. 4, 1999 (SE) ..... 9900789

(51) Int. Cl.[7] ..... A46B 7/00; A46B 13/02; A46B 15/00

(52) U.S. Cl. ..... 15/183; 15/179

(58) Field of Search ..... 15/179, 181, 182, 15/183, 230; 29/895.2

(56) References Cited

U.S. PATENT DOCUMENTS

| | | | |
|---|---|---|---|
| 3,134,123 A | | 5/1964 | Nelson |
| 3,533,125 A | | 10/1970 | Buechel et al. |
| 3,862,463 A | | 1/1975 | Reiter |
| 4,018,014 A | * | 4/1977 | Belanger |

* cited by examiner

*Primary Examiner*—Randall Chin
(74) *Attorney, Agent, or Firm*—Ostrolenk, Faber, Gerb & Soffen, LLP

(57) ABSTRACT

A drum for a brush roller comprised of a plurality of arcuate shaped segments with circumferentially projecting shoulders at their ends. The shoulders have outer edges that contact the adjacent segments and have respective inwardly and outwardly facing surfaces which in adjacent segments overlie and are attached together. Each segment has radially spaced double walls with sufficient rigidity and has reinforcement. The outward side of each segment is provided with a plurality of protruding beams defining U-shaped channels between them. An axle includes the drum with end plates and projecting shafts at each end. Also, a method of assembling the drum wherein the edges of the shoulders are brought against adjacent segments and the shoulders have their respective inwardly and outwardly facing surfaces overlying and fastening elements extend through the shoulders.

16 Claims, 2 Drawing Sheets

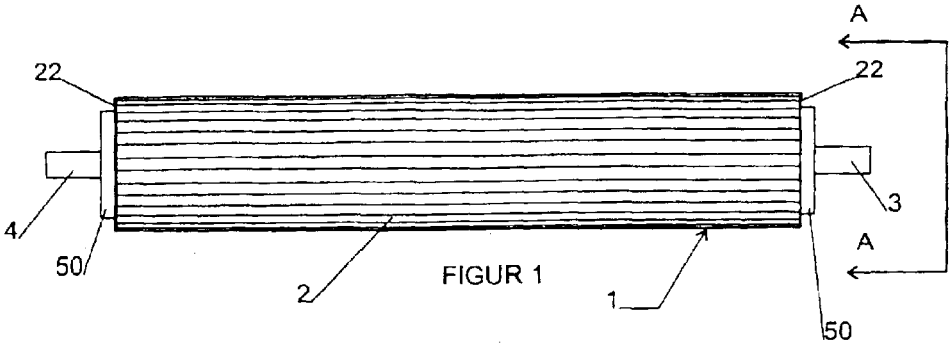
FIGUR 1
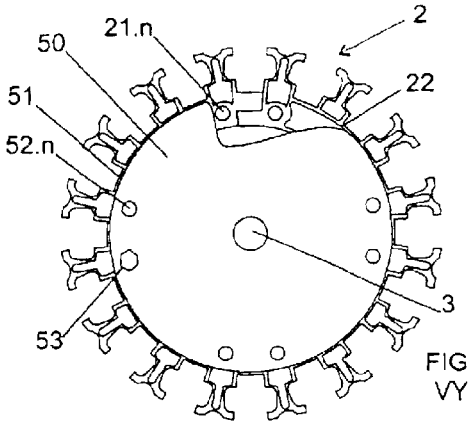
FIGUR 6
VY A-A
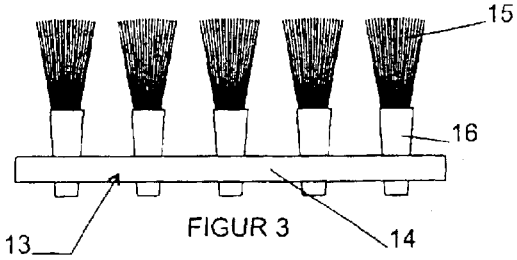
FIGUR 3
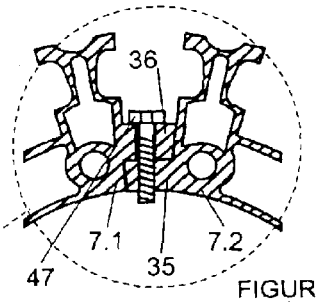
FIGUR 5
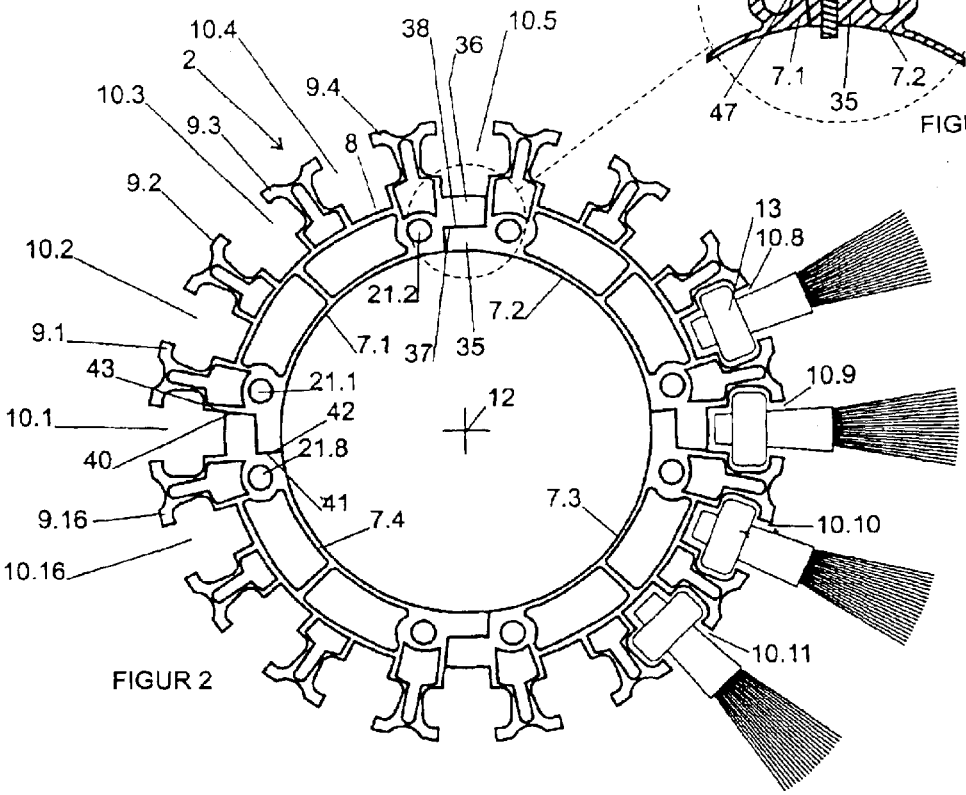
FIGUR 2

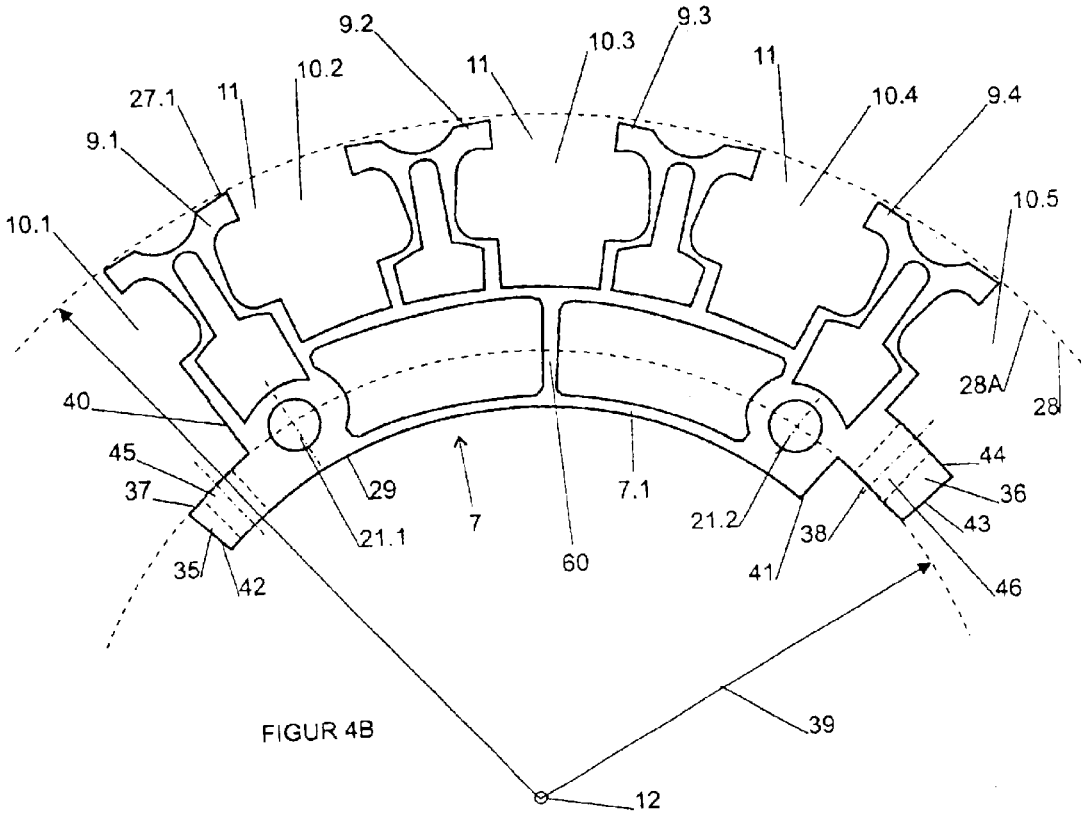
FIGUR 4B
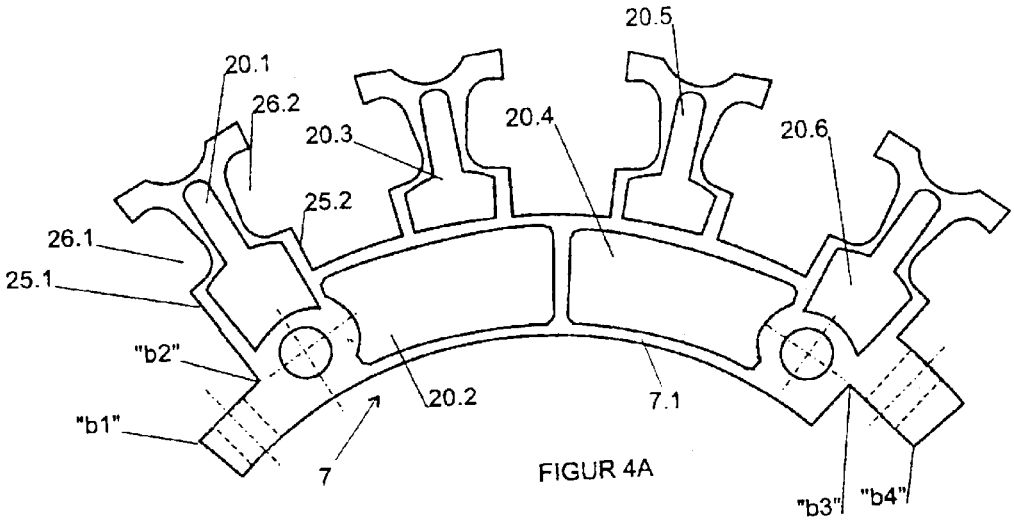
FIGUR 4A

METHOD FOR MOUNTING A DRUM AS WELL AS A DRUM AND AN AXLE FOR A BRUSH ROLLER

TECHNICAL FIELD

The invention relates to a drum as axle in a brush roller. Brush rollers are used for cleaning large flat surfaces and also in industrial context for deburring, polishing or roughening surfaces or edges.

BACKGROUND ART

It is well known that axles for brush rollers, particularly brush rollers used in road cleaning machines, are difficult to manufacture. These brushes generally have a length of between 1.5 to 4 meter and a diameter of between 700 and 1800 mm. The brushes rotate at a speed of between 400 and 1000 r/m.

The traditional method of manufacturing the axle of a brush roller is to attach axial holders on a steel pipe or rod, at the periphery of the pipe. Various types of brush magazines are then fitted in these holders. These axial holders are generally made of extruded aluminium. Other components included in such a brush roller are various forms of key joints and spacers. The steel pipe and spacers are welded together with known precision. A large number of holes for attachment bolts must also be drilled and threaded in the steel pipe. This vast number of components entails high storage costs for material as well as expensive machining costs.

Commercial alternatives available are to design the axle of the brush roller as a fully extruded aluminium section. One problem is that the die used for the extrusion is limited as to size so that only certain maximum diameters can be produced. Furthermore, these extruded aluminium sections are extremely heavy since the material is thick, and it is impossible to reduce their mass by inserting cavities. A considerable drawback when extruding aluminium sections is the banana shape the section acquires on the cooling bed. A section that is 4 meter in length may have a curvature of 4 mm or more. This curvature entails extra work at the dynamic balancing.

It is also known through U.S. Pat. No. 3,134,123 and U.S. Pat. No. 3,862,463 to make the cylindrical axle of the brush roller in segments, which are joined together and anchored, to hub members situated centrally at the ends of the axle. The segments are in the form of thin-walled sections, which are not reinforced in axial direction, and the axle is therefore limited in both length and diameter. This method of constructing the axle of a brush roller does not permit the manufacture of long axles, e.g. 4 m, nor axles having large diameter, e.g. 1200 mm, because of the unbalance occurring at the revolution speeds involved. U.S. Pat. No. 3,134,123 also indicates that the embodiment shown in FIG. 3 constitutes a self-supporting construction. However, this construction is extremely expensive since the dovetail joints of the sections cannot be manufactured without after-working, with the tolerances necessary if the joints are to be free from play. Furthermore, the dovetail form according to U.S. Pat. No. 3,134,123 must have a certain play to enable one section to be axially inserted into another section, and this per se results in play in the construction.

OBJECT OF THE INVENTION

The object of the invention is to solve the problems mentioned above and to improve a drum in the axle of a brush roller so that the axle becomes simpler and less expensive to manufacture, as well as being lighter, which contributes to increased stability at the bearing housings of the axle.

Another object of the invention is to provide a drum for the axle of a brush roller which drum, under dynamic loading, behaves as a rigid cylinder.

A further object of the invention is to provide a drum for a brush roller with relatively large diameter and length, which can be produced from extruded aluminium sections and which, after assembly, performs entirely free from play and with a rigidity equivalent to a homogenous body, e.g. a cylinder.

SUMMARY OF THE INVENTION

The objects stated above are achieved and the drawbacks eliminated by means of the present invention as defined in the claims.

The method for assembling a drum according to the inventive concept is that the drum forms a part of an axle and that the axle constitutes a part of a brush roller. Characteristic of the assembly is that an axle consists of a drum on which an end plate with two shaft ends have been mounted.

The drum preferably has circular cross section. A plurality of axial, preferably U-shaped channels are arranged at the periphery of the drum. A normal axle has 16 channels but the number of channels may be either more or fewer. The drum is preferably made from four segments of extrude aluminium sections.

The number of segments is in no way limited to these four segments but may vary from two or more, e.g. 2, 4, 6 or 8. An even number of sections is preferable in order to achieve dynamic balance in the simplest manner at rotation. The segments exhibit an outer arc shape. Four segments, for instance, are fitted together to form a drum. Each segment has a first edge part with a first shoulder and a second edge part with a second shoulder.

Assembly of four segment sections to a drum is as follows:

In a first step each segment is arranged so that the edge portion of the first shoulder and/or the edge portion of the second shoulder are in contact with the second or first contact surface, respectively, of an adjacent segment. This ensures that the drum will always have the same diameter. A space between the various segments may cause unbalance. The contact surfaces between the shoulders of the segments are flat so as to obtain the greatest possible contact area without having to machine the surfaces. Alternatively the contact surfaces of the shoulders may be provided with pins and recesses in order to a greater extent to take up tangential shear stress between the segments.

A variant of the shape of the segments is to arrange two adjacent segments with the lower side of the second shoulder of a first segment in contact with the upper side of the first shoulder of a second segment.

This is done when the shoulders of the segments are at different levels, i.e. radial distance from the axis of rotation of the axle. An alternative embodiment is the use of two differently shaped segments, alternate segments being identical, i.e. the shoulders on alternate segments are at equal radial distance from the inner arc.

Another factor is that each section is curved at the extrusion. By dividing the drum into segments, the curvature of the segments will be compensated and the drum becomes straight. At one and the same extrusion process each rod will be cooled in the same way and each will acquire similar defects.

A second step entails drilling or drilling and threading through-holes in radial direction, e.g. through the first, outermost shoulder as a clearance hole and through the second, innermost shoulder as a threaded hole, in each segment. Two or more holes are drilled along the segments in each shoulder, at equal or different distances from each other.

The third step entails passing an attachment element, a bolt or a screw and nut, through each hole. This screw joint ensures complete freedom from play, which is necessary if a brush roller 2.5–6.0 meter in length is to be balanced dynamically and then withstand a continuous speed of revolution of up to 1200 rpm.

When the drum is mounted on the axle, a circular plate with a concentrically arranged shaft end is fitted on the end portions of the drum. Congruence exists between every or every other segment incorporated in a drum. The advantage of having only one shape for the segments in the drum is to save costs.

The segments incorporated in a drum exhibit the following characteristics:

the segments consist of extruded aluminium sections;

a segment exhibits an outer arc form;

each aluminium section is provided on its upper side with two or more, preferably four, radially protruding beams;

a U-shaped channel is formed between two adjacent beams;

each segment has a first shoulder and a second shoulder.

In one embodiment the upper side of the first shoulder and the lower side of the second shoulder of a segment preferably have flat surfaces.

The segments are also made double-walled, one or more cavities being formed in each segment. In a segment with two cavities, these cavities are separated by radially reinforced spacers extending axially along the entire length of the segment. The U-shaped channels of the segment are also situated radially in relation to the imagined central axis of the drum.

BRIEF DESCRIPTION OF THE DRAWINGS

One embodiment of the invention is shown schematically in the accompanying drawings in which FIG. 1 shows an axle with its drum and two shaft ends, FIG. 2 shows an end part of a drum including a number of brush magazines inserted into slots, FIG. 3 shows an embodiment of a brush magazine FIGS. 4A–B show a segment FIG. 5 shows a section from FIG. 3 through a join between two segments revealing hole and bolt.

FIG. 6 shows a view A—A in FIG. 1 of an end part of the axle of a brush roller.

DESCRIPTION OF THE INVENTION

FIG. 1 illustrates an axle 1 seen from the front, built up of a drum 2 and two shaft ends 3, 4. Each shaft end 3, 4, which may have the form of part of a spline joint, is mounted on a torque transmitting plate 50 which in turn covers the end part 22 of the drum 2. Two shaft ends 3, 4, each with a-plate 50, together with a drum 2, constitute the axle 1 of a brush roller.

FIG. 2 shows an end part of the drum 2, the drum 2 in this embodiment comprising four segments 7.1, 7.2, 7.3, 7.4. The drum 2 is formed by the four segments 7.1, 7.2, 7.3, 7.4 after assembly. The segments 7.1, 7.2, 7.3, 7.4 are produced from an extruded aluminium section. Each segment 7.1, 7.2, 7.3, 7.4 is provided on its upper side 8 with four radially protruding beams 9.1, 9.2, 9.3, 9.4. In order to reduce manufacturing costs, the segments 7.1, 7.2, 7.3, 7.4 are congruent with each other.

In a drum 2 assembled from four segments 7.1, 7.2, 7.3, 7.4 there are sixteen U-shaped channels 10.1 . . . 10.16, arranged so that a U-shaped channel 10.2 is produced between two adjacent beams 9.1, 9.2. Similarly, the channels 10.1, . . . 10.16 are arranged between the adjacent beams 9.1, . . . 9.16. Rows of brush magazines 13 in which brushes are fitted, are shown in the U-shaped channels 10.8 . . . 10.11. Eight circular, threaded holes 21.1, . . . 21.8 intended for use when assembling the plate 50 with its shaft ends 3, 4 to the end part 22 of the drum 2 are also arranged axially in each segment, preferably in the area below a beam near the ends of the segment. The drum is arranged to rotate about its central axis 12.

FIG. 3 shows an embodiment of a brush magazine 13 comprising a holder 14 for five brushes with card wire 15, pressed into a plastic holder 16.

FIGS. 4A and 4B show an individual segment 7.1 with its extruded aluminium section, seen from the end. When an aluminium section 7 is extruded through a die, all the holes in the die will give the aluminium section 7 an elongate shape. The pattern of holes in a die corresponds with the cross section of the section. In order to reduce the cost at manufacture, as well as the weight, and to increase the rigidity of the section 7, the section is provided with a number of cavities 20.1–20.6, four of which are situated in the beams 9.1, . . . 9.4, and two in the section 7. The two cavities 20.2, 20.4 in the section are formed by the section having double walls and the cavities being separated by radially reinforced spacers 60 extending axially along the entire length of the segment. In this example there are two more holes—the two circular, threaded holes 21.1, 21.2 intended for use when assembling the plate 50 with its shaft ends 3, 4 to the end part 22 of the drum 2, see FIG. 1. Each beam 9.1 . . . 9.4 in the segment 7.1 exhibits a first side part 25.1 and a second side part 25.2, each with a longitudinal slot 26.1, 26.2. Each slot 26.1, 26.2 in each beam 9.1, . . . 9.4, is at the same distance from the central point 12 of the drum. The openings of the slots 26.1, 26.2 face the U-shaped channel 10.1 . . . 10.16. The openings 11 of the U-shaped channels 10.1 . . . 10.16 face away from the centre 12 of the drum 2.

The outwardly facing surfaces 27.1 . . . 27.16 of the beams 9.1, 9.2 when the segments 7.1 . . . 7.4 are assembled to a drum 2, are at a tangent to a circumscribed circle 28. Each segment 7.1, 7.2, 7.3, 7.4 has an outer arc shape 28A. One segment 7.1 in this example shows an inwardly facing surface 29 which also has an arc shape. Both the circumscribed circle 28 and the inwardly facing arc-shaped surface 29 have the same radial centre 12. A first shoulder 35 is arranged on the section 7, tangentially outside the first beam 9.1, and a second shoulder 36 is arranged on the section tangentially outside the fourth beam 9.4. The surfaces of the upper side 37 of the first shoulder 35 and the lower side 38 of the second shoulder 36 are preferably flat but may also assume an arc shape with a common radius 39. The centre of the radius 39 is at the centre 12 of the drum. The width "b1–b2", i.e. the distance from the inner corner b2 between the upper side 37 of the shoulder 35 and a first radial contact surface 40 on the first beam 9.1 to the outer corner b1 of the shoulder 35 is preferably equal to the width "b3–b4", i.e. the distance from the inner corner b3 between the lower side 38 of the second shoulder and a second radial contact surface 41 below the fourth beam 9.4 to the outer corner b4 of the shoulder 36.

The outside of the preferably upwardly directed part at the upper side 37 of the first shoulder 35 is thus designated a first contact surface 40. The outside of a preferably radially downwardly directed part at the lower side 38 of the shoulder 36 is corresponding designated a second contact surface 41.

The first shoulder 35 is provided with a first edge part 42. This edge part 42 extends from the lower side 29 of the shoulder 35 to its upper side 37. The second shoulder 36 is provided with a second edge part 43 extending from the lower side 38 of the shoulder 36 to the upper side 44 of the shoulder 36.

Assembly of the drum 2 is performed as follows:

a) four segments 7.1, 7.2, 7.3, 7.4, FIGS. 4A, 4B, are arranged close to each other as shown in FIG. 2 in such a way that the upper side 37 of the first shoulder 35 of a segment 7.1, 7.2, 7.3, 7.4 is brought into contact with the lower side 38 of a second shoulder 36;

b) the first shoulder 35 of each segment 7.1, 7.2, 7.3, 7.4 and its first edge part 42 are brought into contact with the second contact surface of adjacent segments 7.1, 7.2, 7.3, 7.4, see FIG. 2;

c) the second shoulder 36 of each segment 7.1, 7.2, 7.3, 7.4 and its second edge part 43 are brought into contact with the first contact surface 40 of adjacent segments, see FIG. 2;

d) an alternative to b) and c) is for either a first edge part 42 to be in contact with a second contact surface 41 or a second edge part 43 to be in contact with a first contact surface 40;

e) holes 45, 46 are drilled and threaded in radial direction, FIGS. 4A, 4B, through each first 35 and second shoulder 36.

f) a plurality of holes 45, 46 are drilled at equal or different axial distance from each other;

g) an attachment element 47, FIG. 5, bolt, is arranged through each hole 45, 46 in such a manner that a friction joint is obtained between the shoulders 35, 36 at the contact surface 37, 38.

FIG. 5 shows a section through a joint in FIG. 2 between two adjacent segments 7.1, 7.2. The section shows that the segments have been assembled using a screw joint, the second shoulder 36 of one segment 7.1 having a throughhole radially-aligned with a threaded hole through the first shoulder 35 of the second segment 7.2. An attachment 47 in the form of a bolt, i.e. a machine screw, is screwed through these holes. The flat contact surfaces 37, 38 are thus pressed against each other, see FIG. 2. The upper side 44 of the shoulder 36 is also flat in order to provide the best possible contact surface for the attachment element 47.

FIG. 6 shows a view A—A in FIG. 1 with part of the plate 50 removed. The figure shows the end of the axle 1 with its shaft end 3 arranged concentrically with the plate 50. Holes 52.n are arranged at the periphery 51 of the plate 50, where n=1, . . . 8, for a second attachment element 53 in the form of an axially fitted bolt. The distance between the holes 52.1 . . . 52.8 corresponds to the distance between the threaded holes 21.n, where n=1, . . . 8, at the end part 22 of the drum 2.

Assembly of the plates 50 with their shaft ends 3, 4 to the drum 2 is performed as follows:

a) a shaft end 3, 4 and its torque-transmitting plate 50 is arranged at each end part 22 of the drum 2;

b) the shaft ends 3, 4 with plate 50 are arranged concentric with the end part 22 of the drum 2;

c) the attachment element 53 is screwed through the holes 52.1, . . . 52.8 in each plate 50 and into the holes 21.1, . . . 21.8 in the end part 22 of the drum 2.

The invention is not limited to the example described but can be used in all drums built up of segments to be used as part of an axle where each segment is in the form of an extruded section and where each segment has two shoulders that are united with an attachment element. The invention is not limited to a certain number of segments but applies to all segments amounting to two or more. Neither is the invention in its widest scope limited to the drum assuming the shape of a cylinder. It may also assume the shape of an equilateral polygon.

What is claimed is:

1. A drum for a brush roller, wherein the drum is comprised of a plurality of segments, each segment having opposite first and second ends with respect to a rotation direction of the drum, the first end of each segment cooperating with the second end of the adjacent segment and the adjacent segments are joined to form a drum;

each segment having an upper side which is outwardly facing when the segments are joined;

a plurality of outwardly protruding beams on the upper outwardly facing side, the beams being shaped and placed to define a respective U-shaped channel between adjacent beams on the segment;

each segment having a double wall, with an inward wall toward an inner side of the segment, an outward wall toward the upper side of the segment, and the inward and outward walls being sufficiently rigid for the assembled segments to form a fully self-supporting drum when the segments are joined at the respective cooperating first and second ends of adjacent segments;

a torque transmitter connected to the drum for rotating the drum about an axis.

2. The drum of claim 1, wherein there are four outwardly protruding beams on each of the segments.

3. The drum of claim 1, further comprising reinforcing spacers between the double walls of the segments.

4. The drum of claim 1, wherein the segments are shaped so that at least two of the segments are congruent.

5. The drum of claim 1, wherein the upper side of each of the segments defines an outer arcuate shape, and the segments are of such circumferential length and are of such number that when the segments are joined with the first side of one segment adjacent the second side of the adjacent segment, the drum has a cylindrical drum shape.

6. The drum of claim 5, wherein each segment has a respective first shoulder projecting outwardly from the first end and has a respective second shoulder projecting outwardly from the second end, with the first and second shoulders being respectively so placed on the ends of the segments that the first shoulder has an upper outwardly facing first surface and the second shoulder has a lower inwardly facing second surface.

7. The drum of claim 6, wherein the outwardly facing first surface of the first shoulder of one segment has resting on it the inwardly facing second surface of the second shoulder of the adjacent segment.

8. The drum of claim 7, wherein the first and second surfaces are flat and oriented parallel.

9. The drum of claim 8, further comprising fastening elements between the first and second shoulders at adjacent segments for joining the adjacent segments.

10. The drum of claim 6, wherein there are a plurality of the segments, the segments are extruded, are of arcuate shape and are of identical length.

11. An axle for a brush roller, comprising a drum according to claim 6, the drum having opposite axial ends;

a respective torque transmitting plate arranged concentrically in relation to and connected to each of the axial ends of the drum; and a respective shaft and projecting from each of the torque transmitting plates.

12. The drum of claim 7, wherein the shoulders have respective outer edges and each of the outer edges of the shoulders rests against the adjacent segment.

13. The drum of claim 1, wherein each segment has a respective first shoulder projecting outwardly from the first end and has a respective second shoulder projecting outwardly from the second end, with the first and second shoulders being respectively so placed on the ends of the segments that the first shoulder has an upper outwardly facing first surface and the second shoulder has a lower inwardly facing second surface.

14. The drum of claim 13, wherein the outwardly facing first surface of the first shoulder of one segment has resting on it the inwardly facing second surface of the second shoulder of the adjacent segment.

15. The drum of claim 1, wherein each of the segments is an extruded aluminum section including the respective shoulders at the opposite first and second ends.

16. The drum of claim 1, wherein there are an even number of segments.

* * * * *